US007833144B1

(12) United States Patent
Como et al.

(10) Patent No.: US 7,833,144 B1
(45) Date of Patent: Nov. 16, 2010

(54) STRENGTH TRAINING WORKOUT BENCH

(75) Inventors: Ellen Como, Valencia, CA (US); Stephen M Beaulieu, Valencia, CA (US); Tony Greasley, Valencia, CA (US); Michele Beaulieu, Valencia, CA (US)

(73) Assignee: Core Bench Fitness, Valencia, CA (US)

( * ) Notice: Subject to any disclaimer, the term of this patent is extended or adjusted under 35 U.S.C. 154(b) by 0 days.

(21) Appl. No.: 12/456,275

(22) Filed: Jun. 15, 2009

(51) Int. Cl.
*A63B 26/00* (2006.01)

(52) U.S. Cl. ..... 482/142; 482/907

(58) Field of Classification Search ..... 482/140, 482/142, 148, 121–130, 111, 51, 53; 446/220; 601/5, 1
See application file for complete search history.

(56) References Cited

U.S. PATENT DOCUMENTS 4,422,634 A * 12/1983 Hopkins ..... 482/8
5,369,828 A * 12/1994 Graebe ..... 5/654
5,913,758 A * 6/1999 Nunez ..... 482/142
6,322,484 B1 * 11/2001 Muller ..... 482/140
6,422,983 B1 * 7/2002 Weck ..... 482/147
6,899,662 B2 * 5/2005 Gamble et al. ..... 482/142
7,074,166 B2 * 7/2006 Weitzman ..... 482/142
7,344,488 B2 * 3/2008 Weck et al. ..... 482/147
7,392,559 B2 * 7/2008 Peterson ..... 12/1 R

* cited by examiner

*Primary Examiner*—Lori Baker
(74) *Attorney, Agent, or Firm*—Jeffrey G. Sheldon; Sheldon Mak & Anderson

(57) ABSTRACT

A rectangular workout bench with removable legs for use directly on the floor or raised on legs has an inflatable flexible air filled plastic material cushion work out area allowing a person to lay on for physical therapy, strength training and balance. The rectangular shape allows spine and neck support while the instability of the air filled cushion allows muscles to activate. Beginners use the workout cushion directly on the floor and advanced workouts are on the elevate elevated bench with accessible footrests.

6 Claims, 5 Drawing Sheets

STRENGTH TRAINING WORKOUT BENCH

FIELD OF THE INVENTION

This invention relates to a persons strength training and balance while supported by a body length flexible cushion. The cushion instability allows movement and muscle activation while supporting the spine and neck. Footrest protrusions provide support and stability while working out.

BACKGROUND OF THE INVENTION

Physical training and work out is a part of daily life for thousands of people over the world. A need for a work out medium which will support a body length when lying down and still allow movement of the body muscles is evident. Weck and Cotter 6422983 shows us the very popular spherical shaped Bosu ball design which provides a flexible single point support platform for stability training. The potential of misuse is great since only a local support of the body is achieved.

The proposed rectangular strength training work out bench overcomes this potential problem by supporting the body over its length allowing very active training in both the floor position for beginners and the elevated bench position for advanced work out.

SUMMARY OF THE INVENTION

In accordance with the present invention an object of the invention is to provide a workout platform that supports the entire weight of a person while allowing the movement of the body muscles with the head neck and spine held in suspension as movement is achieved. The legs of the preferred bench embodiment are removable allowing a safe floor platform for the beginner to workout on while the elevated configuration provides increased freedom of movement for the user while being stabilized using the foot rest protrusions provided on the far end of the rectangular cushioned platform.

DETAILED DESCRIPTION OF THE PREFERRED EMBODIMENTS

Figure 1:
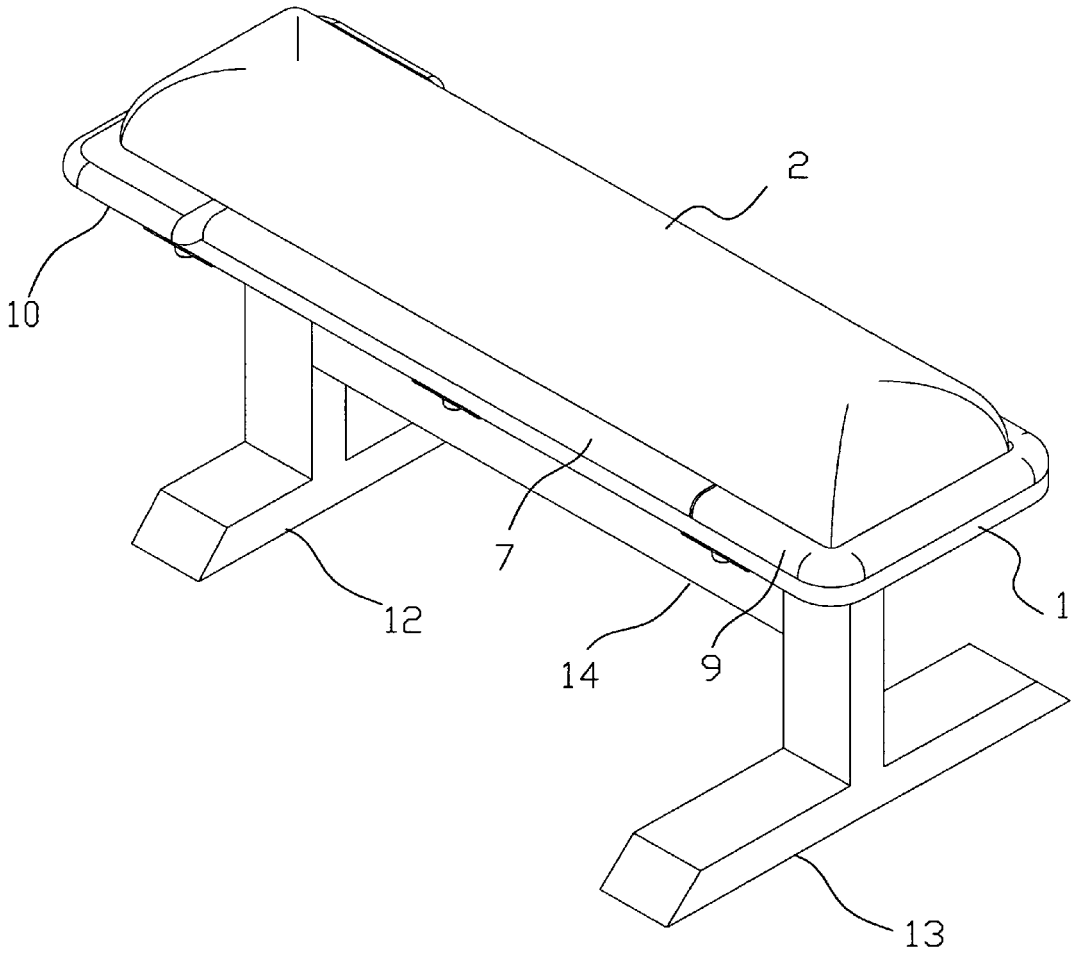
FIG. 1 shows a perspective view of the strength training work out bench invention in the advanced user elevated position with the legs attached.
Figure 3:
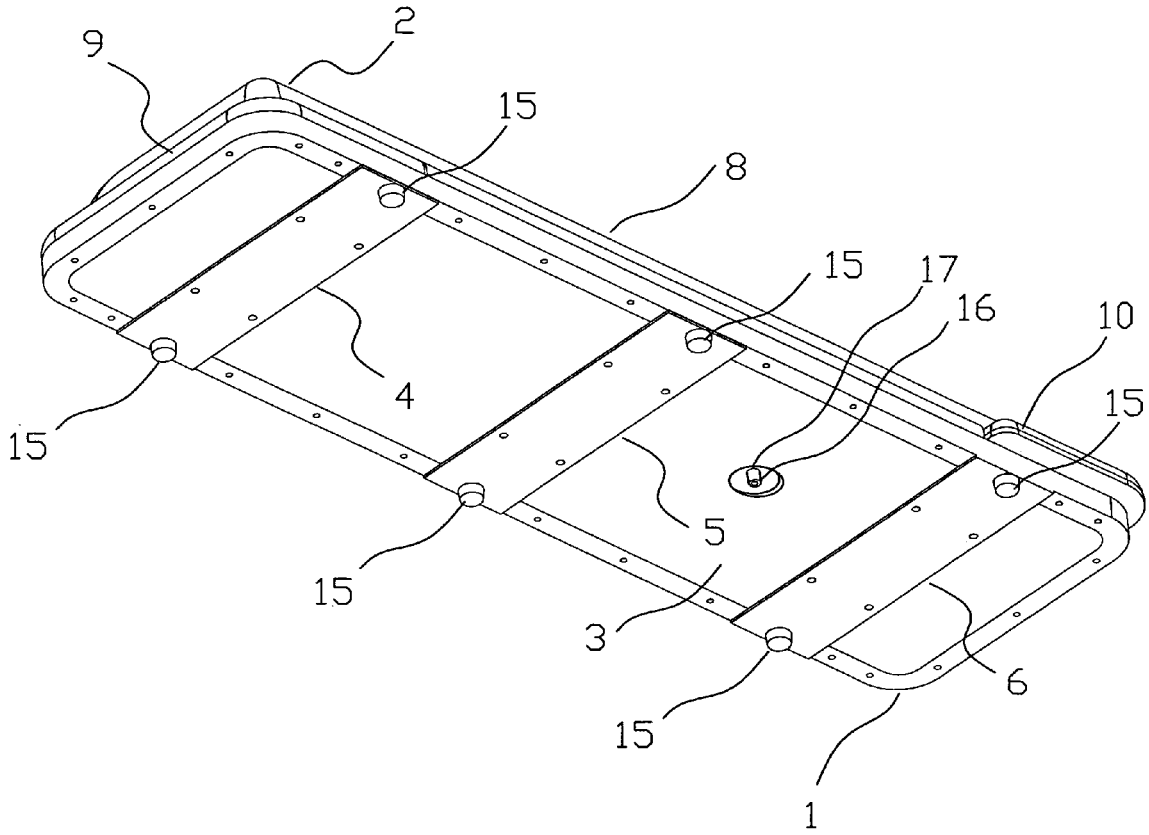
FIG. 3 shows the bottom perspective view of the workout bench with access to the flexible cushion air fill port as well as the cross braces for mounting the legs.
Figure 4:
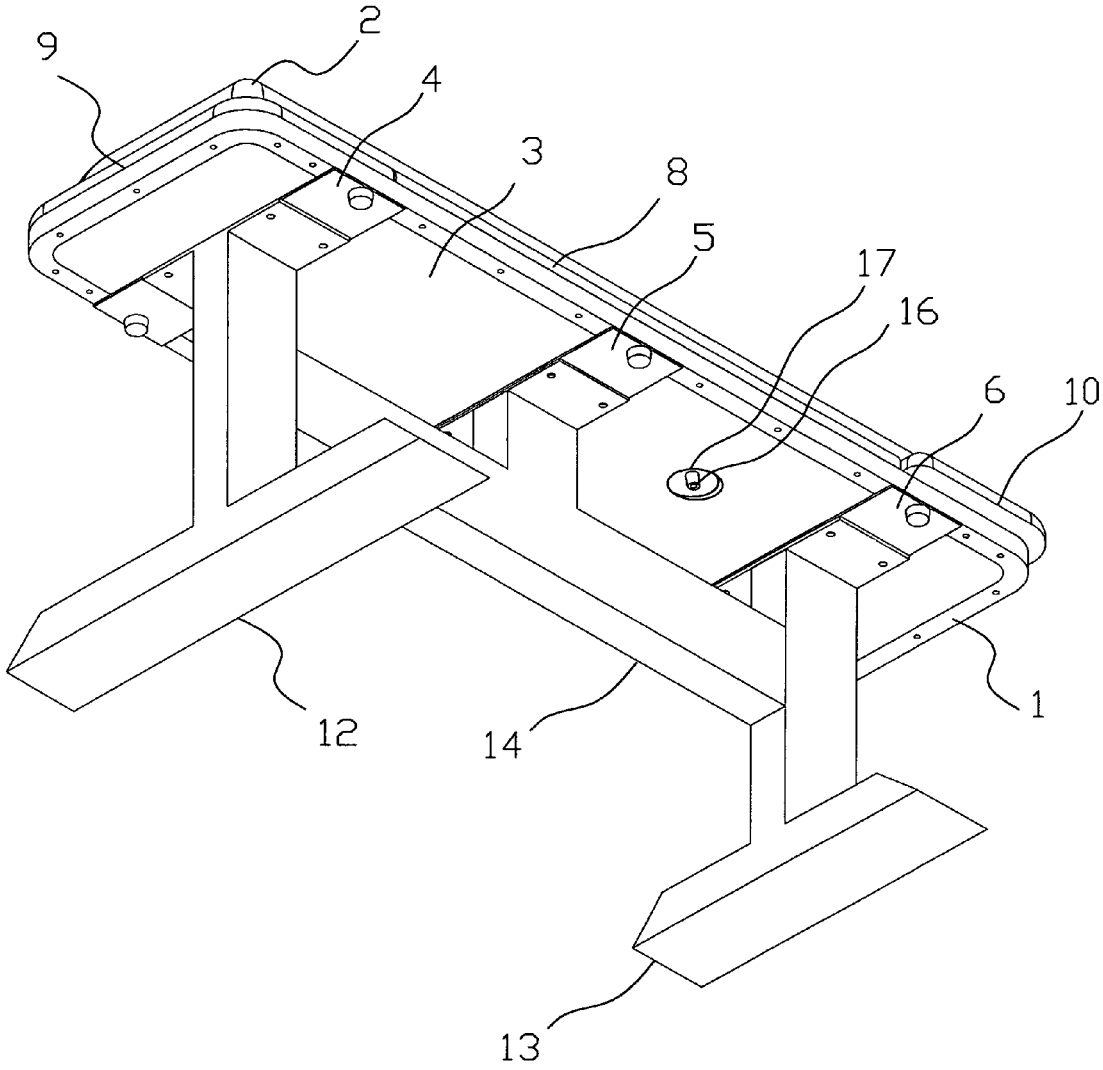
FIG. 4 shows the bottom perspective view of the workout bench with the legs installed as well as access to the cushion air fill port.

Reference to FIG. 1 shows a work out bench having a rectangular steel frame 1 surrounding a flexible air filled plastic cushion 2 supported by a base board 3 shown in FIGS. 3 and 4 resting on cross brace 4, 5 & 6 attached to the rectangular steel frame 1.

Figure 5:
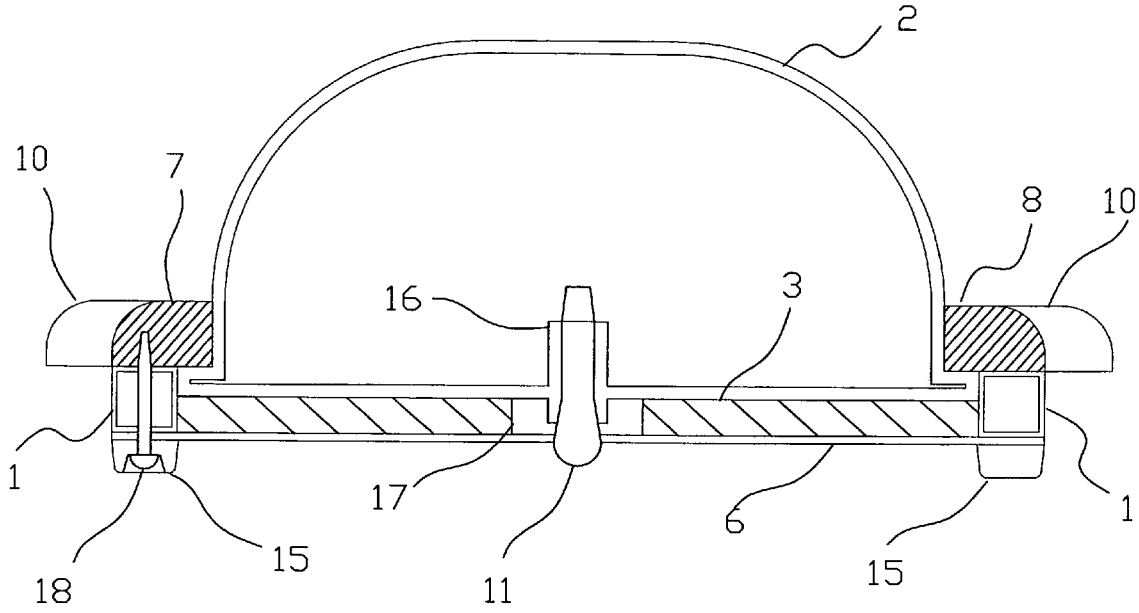
FIG. 5 is a cross sectional view of the air filled cushion and the method by which it is clamped to the work out bench platform.

Reference to FIG. 5 The air filled flexible cushion 2 resting on the base board 3 is clamped in place by molded plastic retainers 7, 8, 9 and 10 which are bolted to the steel frame 1 with self threading screws 18 into the plastic retainers 7, 8, 9 & 10. The base board 3 and retainers 7, 8, 9 & 10 capture the surrounding edge of the air filled flexible cushion 2 as shown in FIG. 5.

The plastic retainer 10 see FIG. 1 on the foot end of the workout bench is wide with a step in width from the adjacent retainers 7 and 8 providing a resting place for your feet when working out on the work out bench.

Figure 2:
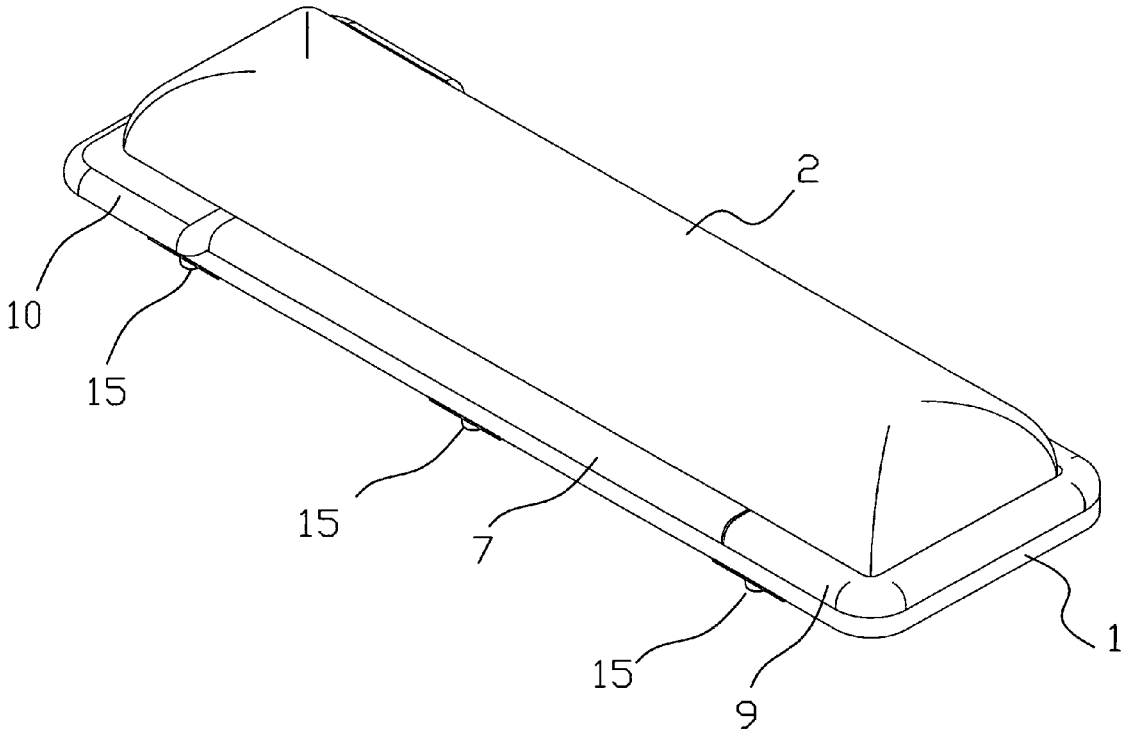
FIG. 2 shows a perspective view of the strength training workout bench invention with the legs removed. The strength training work out bench is placed directly on the floor.

The elevated bench assembly shown in FIG. 1 rests on legs 12, 13 and cross brace 14 shown in FIGS. 1 and 4. The legs are attached by removable means to cross brace 4, 5 & 6 shown in FIG. 3. Removal of the legs 12, 13 and cross brace 14 allows the work out bench to be placed directly on the floor resting on rubber bumpers 15 shown in FIGS. 3 and 4 to be used as a beginners bench configuration as seen in FIG. 2.

FIG. 5 shows the flexible air filled cushion 2 resting on the base 3 surrounded by the rectangular steel frame 1. The edge of the flexible air filled cushion 2 is molded integral to the cushion and provides a semi rigid periphery to the flexible air filled cushion such that when clamped between the base 3 and the retainers 7,8,9 and 10 surrounded by the rectangular steel frame the flexible air filled cushion expands upwards when air pressure is applied through port 16 filling the molded rectangular shape of the cushion as required to support the full weight of a person exercising on the work out bench. Fill port 16 shown in FIGS. 3, 4 & 5 is centrally located in the lower surface of the air filled plastic cushion such as to be accessible from the bottom of the work out bench through a access hole 17 located in the base 3. Proper air filling of the cushion 2 provides support for various weight individuals. Air filling can be adjusted by removing the filler plug 11 shown in FIG. 5 and adding or releasing air pressure to the cushion 2 and then replacing the filter plug 11 when the cushion 2 is properly inflated. Because of the large surface area of the flexible plastic cushion relative to an individuals size, pressure to support the individual laying down on the cushion requires only a low level of air pressure dependant on the weight of the individual using the workout bench.

What is claimed is:

1. An exercise method comprising the steps of:

a) laying prone on a cushion of an exercise apparatus with the entire weight supported and with the head, neck, and spine held in suspension, the exercise apparatus comprising (i) a bench comprising a rectangular platform and a support for holding the rectangular platform above the ground, the platform having an upper surface, and (ii) the cushion being a single, rectangular air filled cell secured to the upper surface of the platform, the cushion having a dome-shaped upper surface, a length, and a longitudinal axis, wherein the apex of the upper surface of the cushion extends along the length of the cushion parallel to the longitudinal axis of the platform for creating instability when exercising, and wherein the bench has opposed sides and a foot section, and further comprising non-movable foot supports sufficiently wide to place feet while exercising on the apparatus, wherein there is a foot support on each side of the bench at the foot section;

b) placing feet on the foot supports; and c) moving body muscles.

2. An exercise apparatus comprising:

a) a bench comprising a rectangular platform and a support for holding the rectangular platform above the ground, the platform having an upper surface, the bench having opposed sides and a foot section;

b) a single flexible, rectangular air filled cushion secured to the upper surface of the bench, the cushion having a peripheral edge, a dome-shaped upper surface, a length, and a longitudinal axis, wherein the apex of the upper surface of the cushion extends along the length of the cushion parallel to the longitudinal axis of the platform for creating instability when exercising; and c) a retainer securing the edge of the cushion to the platform, the retainer comprising non-movable foot retainers sufficiently wide to place feet while working out on the apparatus, wherein there is a foot retainer on each side of the bench at the foot section.

3. The apparatus of claim 2 wherein the support comprises legs.

4. The apparatus of claim 2 wherein the support is removable the bench so that the apparatus without the support can be used.

5. The apparatus of claim 2 comprising an air fill port for the cushion in the cushion proximate to the platform, and an access hole to the fill port in the platform.

6. The apparatus of claim 2 wherein the foot retainers are wider than other retainers.

* * * * *